US005687545A

United States Patent [19]

Baker

[11] Patent Number: 5,687,545

[45] Date of Patent: Nov. 18, 1997

[54] APPARATUS FOR SEALING AND SEPARATING PERFORATED FLEXIBLE BAGS

[75] Inventor: Tony D. Baker, Hudson, Ohio

[73] Assignee: Advanced Poly-Packaging, Inc., Akron, Ohio

[21] Appl. No.: 540,560

[22] Filed: Oct. 6, 1995

[51] Int. Cl.[6] ..... B65B 61/20

[52] U.S. Cl. ..... 53/284.7; 53/373.7; 53/384.1; 53/385.1; 53/389.2; 225/100

[58] Field of Search ..... 53/570, 389.2, 53/384.1, 385.1, 373.7, 375.6, 284.7; 225/100, 103, 106

[56] References Cited

U.S. PATENT DOCUMENTS

| | | | |
|---|---|---|---|
| 3,329,260 | 7/1967 | Medleycott | 53/385.1 |
| 3,477,196 | 11/1969 | Lerner | 53/570 |
| 3,682,051 | 8/1972 | Sengewald | 53/384.1 |
| 4,011,708 | 3/1977 | Brown, Jr. | 53/384.1 |
| 4,393,640 | 7/1983 | Cole et al. | 53/385.1 |
| 4,688,708 | 8/1987 | Irvine et al. | 225/100 |
| 5,064,408 | 11/1991 | Bridgeman | 53/385.1 |
| 5,131,213 | 7/1992 | Shanklin et al. | 53/373.7 |
| 5,230,453 | 7/1993 | Meschi | 225/100 |
| 5,321,230 | 6/1994 | Shanklin et al. | 53/373.7 |

*Primary Examiner*—John Sipos
*Assistant Examiner*—Gene L. Kim
*Attorney, Agent, or Firm*—Renner, Kenner, Greive, Bobak, Taylor & Weber

[57] ABSTRACT

An apparatus is provided for filling and sealing flexible poly bags which are provided on a continuous roll. The apparatus has means for heat sealing filled bags. A drive mechanism conveys the bag into position for filling and sealing thereof. A clamp mechanism draws the bags into contact with the heat sealing means during the sealing process. A reverse actuation mechanism is provided for reversing the drive mechanism while the bag remains clamped so as to detach the bag at a perforation thereof. An interrupt means is also provided for disengaging the clamp mechanism when the clamp mechanism is interfered with by a foreign object. The interrupt means consists of an electrical circuit established through the clamp mechanism frame which circuit is broken when the clamp mechanism contacts a foreign object. Also provided is a guide mechanism for guiding the bags into engagement with the drive mechanism. The guide mechanism includes a pair of rollers which are in frictional contact with a table member, and a pair of belts are drivingly connected between the rollers and the drive means.

16 Claims, 5 Drawing Sheets

APPARATUS FOR SEALING AND SEPARATING PERFORATED FLEXIBLE BAGS

TECHNICAL FIELD

The invention herein resides in the art of packaging machinery. More particularly, the invention relates to machinery for filling and sealing perforated flexible poly bags provided on a continuous roll. Specifically, the invention relates to an apparatus for heat sealing and separating such bags after sealing.

BACKGROUND ART

It is well known that flexible poly bags are widely used in the packaging industry. It is further known to provide such bags on a continuous roll with individual bags being connected at a perforation. Accordingly, various machines and methods have been developed to rapidly open, fill, and seal such bags. Typically, bags are threaded through a series of rollers which are mechanically driven by an electric motor. The bags are passed beneath a continuous and/or pulsed air stream which serves to open the bag, at which time the bag may be filled either manually or automatically. The bag may then be sealed using either an adhesive or a heat sealing technique. Such heat sealing techniques typically involve the use of a heated seal bar which is briefly held in contact with the bag by a clamping mechanism. The heated seal bar is usually coated or covered with a non-stick material which is often provided in the form of a woven fabric. While these types of materials are highly effective in preventing the bag material from sticking to the seal bar, the extreme heat and frictional forces require that the material be frequently rotated or replaced.

Another disadvantage with known systems is that the mechanism for clamping the bag against the seal bar is subject to interference of objects which are accidentally interposed between the clamping mechanism and the seal bar. Such obstructions tend to damage the machine or otherwise jam the bag path. Accordingly, it has been known to provide interference sensors, in the form of optoelectronic devices which are often quite expensive.

It is further known to provide such machines with means for separating individual bags from one another at the perforation after sealing. Known systems for accomplishing this function have generally involved the use of a brake on the main drive roll to maintain the trailing edge of the bags in a fixed position while the bag to be detached remains clamped between the seal bar and the clamp mechanism. The clamp and seal mechanism is then moved away from the drive rolls, thereby causing the bag to separate from the roll at the perforation. This is typically accomplished by pivoting the clamp and seal bar mechanism relative to the rolls. The rather severe movement required produces a great deal of vibration and requires heavy duty hardware, increased maintenance and adjustment measures, and multiple actuation mechanisms. More recently it has been known to separate perforated bags by disengaging the drive roll from the drive motor, braking the roll, and then temporarily reversing the drive roll by way of a servo-drive or stepper motor while the bag to be sealed remains clamped at the seal bar. While this method is a great improvement over previously known methods, the required stepper motors and/or servos involve elaborate control systems and are not practical for high speed operations. Further, such servo and/or stepper motor systems are expensive and thus are often cost prohibitive.

It has also been known to provide packaging machinery with means to automatically feed bags into the device so as to automatically thread the machine. Such devices have involved a plurality of driven belts wherein an upper set of belts is maintained in contact with a lower set of belts and the bags are interposed therebetween to frictionally guide the bags in the proper path. These mechanisms require tedious adjustments of both belt position and tension in order to function properly.

Thus it is desired to obtain a packaging apparatus and method which will serve to overcome the foregoing disadvantages.

DISCLOSURE OF INVENTION

In light of the foregoing, it is a first aspect of the invention to provide a packaging apparatus for filling and sealing flexible poly bags.

Another aspect of the invention is the provision of an apparatus which allows for heat sealing of such bags.

Yet a further aspect of the invention is the provision of a means for detaching individual hags after filling and sealing thereof.

Still a further aspect of the invention is the provision of a means for automatically feeding and/or threading the bags into the machine.

Yet another aspect of the invention is the provision of a means for disabling the clamp bar mechanism when the same is interfered with by a foreign object.

A further aspect of the invention is the provision of such an apparatus which is inexpensive to manufacture and maintain and also easy to use.

The foregoing and other aspects of the invention which will become apparent as the detailed description proceeds, are achieved by the improvement in an apparatus for filling and sealing flexible poly bags provided on a continuous roll, the apparatus having means for heat sealing the filled bags, the improvement comprising: drive means for conveying the bags into a position for filling and sealing; clamp means for maintaining the bags in position during sealing; reversal means for detaching the bags from one another; interrupt means for disengaging said clamp means when said clamp means is interfered with by a foreign object; and guide means for guiding the bags into engagement with said drive means.

Other aspects of the invention are obtained by a device for detaching perforated poly bags from one another comprising; a drive shaft having first and second ends; a first torque transfer device engaging said first end of said drive shaft; a second torque transfer device engaging said second end of said drive shaft; a drive motor drivingly connected to said first torque transfer device; a first roll member drivingly connected to said second torque transfer device; a second roll member in fictional contact with said first roll member; reverse actuating means also connected to said second torque transfer device; and clamping means for selectively maintaining the bags in a fixed position; whereby said drive motor drives said first and second roll members when said first torque transfer device is engaged and said second torque transfer device is disengaged so as to convey the bags between said first and second roll members and the bags are detached when said first torque transfer device is disengaged, said second torque transfer device is engaged, said bags are maintained in said clamping means, and said reverse actuating means is actuated.

Further aspects of the invention are attained by a guide device for guiding flexible poly bags through a filling and sealing machine, the machine having at least one drive roll member, the device comprising: a table member mounted in the machine; roller means in contact with said table member; at least one belt member engaging said roller means and connected to the drive roll; said roller means maintaining said belt member in frictional contact with said table member.

Yet another aspect of the invention is obtained by the provision of a heat shield for a machine for heat sealing flexible poly bags, the machine having a heated seal bar, a gripper plate having a recess for receiving the seal bar, and a non-stick material interposed between the seal bar and the gripper plate, the heat shield comprising: a thin sheet of resilient heat resistant material interposed between the seal bar and the non-stick material; at least one mounting tab in said sheet of heat resistant material; and, a slotted aperture in said sheet of heat resistant material, said slot adapted to allow only a minimal part of the seal bar to contact the non-stick material.

Still further aspects of the invention are attained by an interference interrupt device for the clamping mechanism of a heat sealing apparatus for sealing flexible poly bags, the interrupt device comprising: a non-conductive clamp bar member; an electrically conductive pressure pad member mounted in said clamp bar member; at least two electrically conductive contact strips mounted in said clamp bar member; at least two rod members mounted in said clamp bar member, one of said at least two rod members electrically connected to one of said at least two contact strips and the other of said at least two rod members electrically connected to the other of said at least two contact strips; fastener means for selectively biasing said pressure pad member to establish an electrical connection with said contact strips; a positive electrical potential connected to one of said at least two rod members; and, a negative electrical potential connected to the other of said at least two rod members; whereby an electrical circuit is established between said positive potential and said negative potential when said fastener means biases said pressure pad member into electrical connection with said contact strips and said circuit is interrupted when said pressure pad is not biased into electrical connection with said contact strips.

BRIEF DESCRIPTION OF THE DRAWINGS

For a complete understanding of the objects, techniques, and structure of the invention, reference should be made to the following detailed description and accompanying drawings wherein.

BEST MODE FOR CARRYING OUT THE INVENTION

Figure 1:
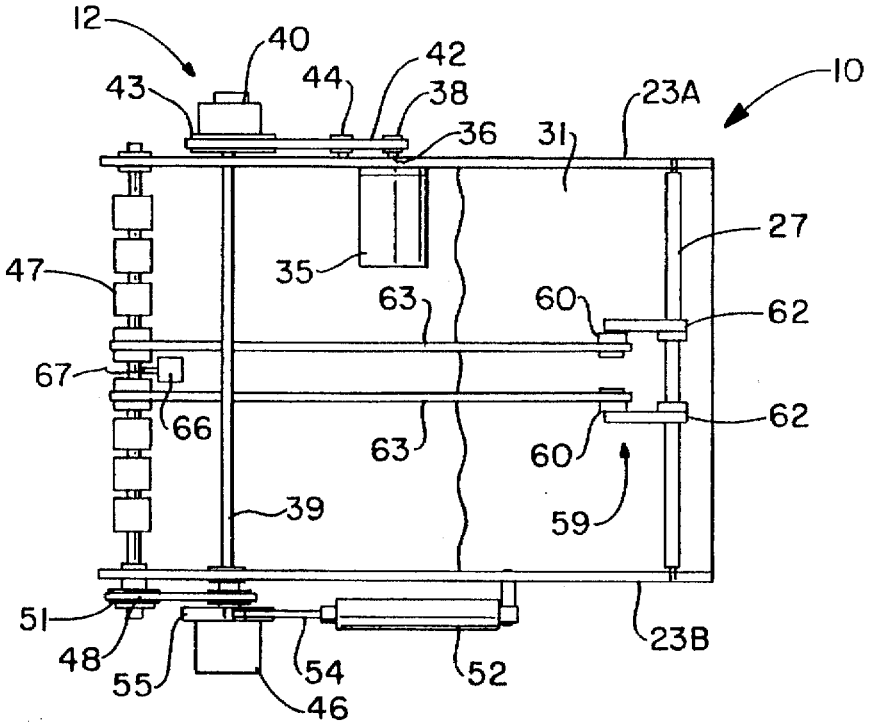
FIG. 1 is a top plan view of an apparatus according to the invention.
Figure 2:
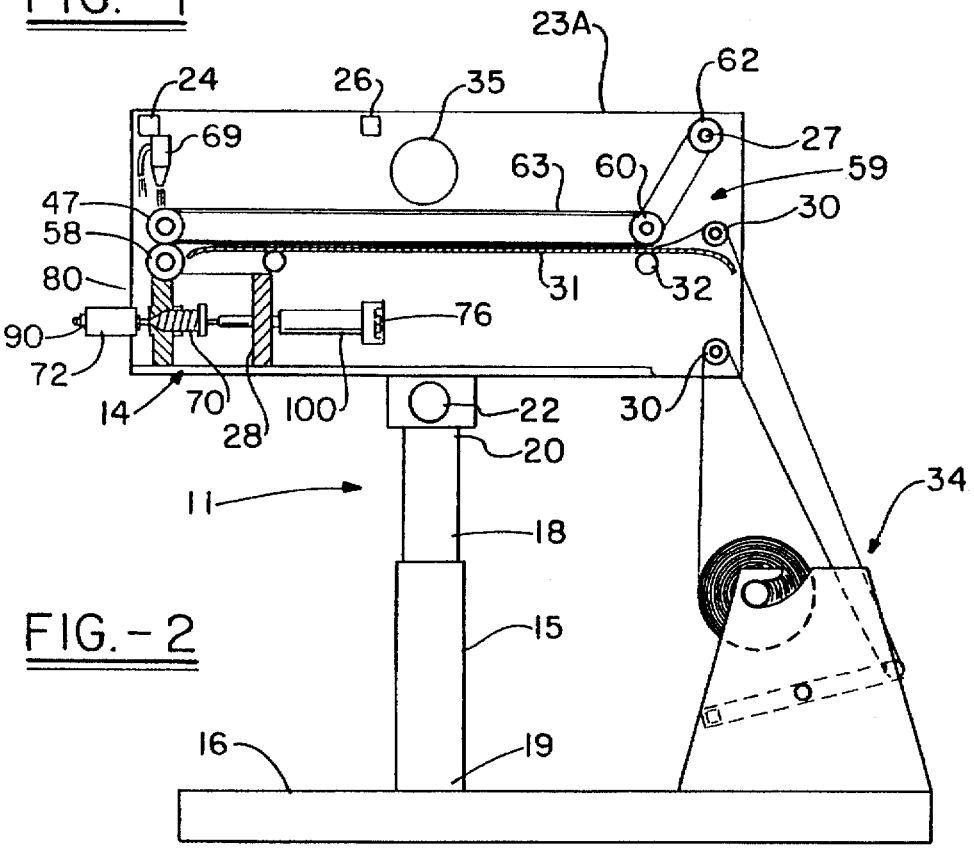
FIG. 2 is a cross sectional side view of the apparatus.
Figure 3:
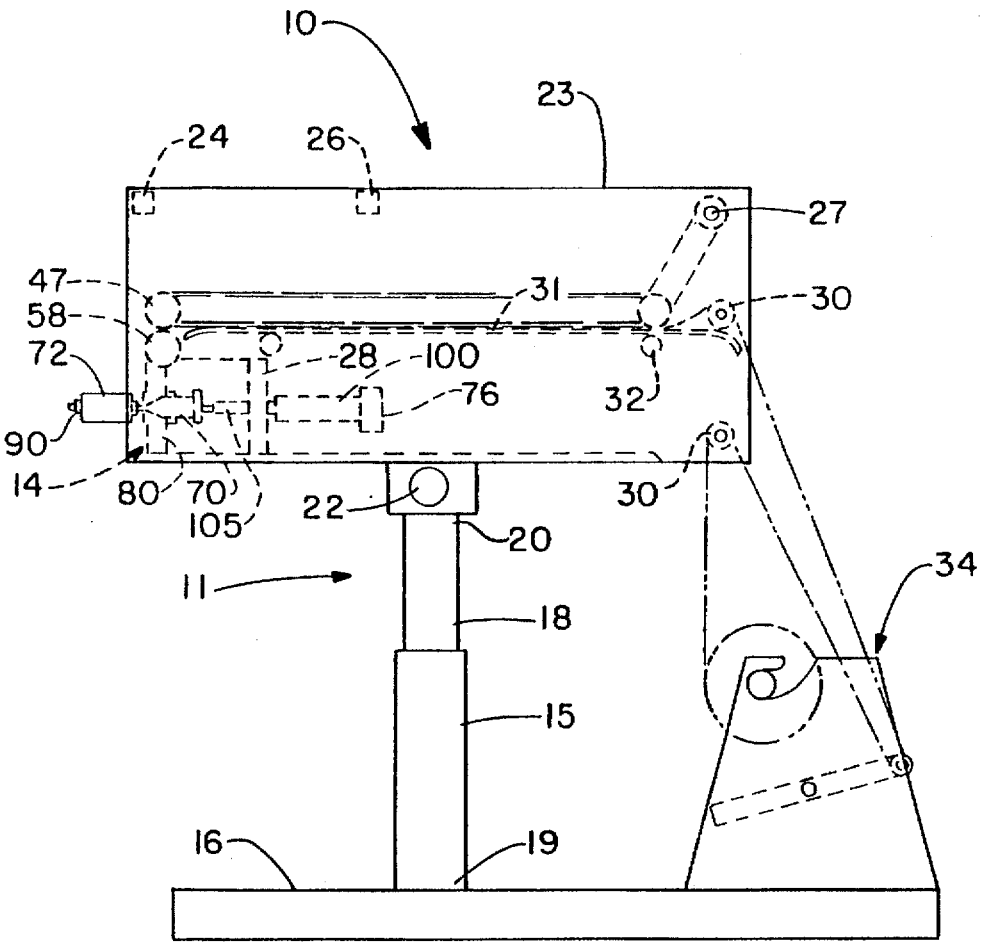
FIG. 3 is an elevational side view of the support frame of the apparatus.

Referring now the drawings and more particularly to FIGS. 1–3, it can be seen that a packaging device according to the invention is designated generally by the numeral 10. As can be seen, the device 10 is comprised generally of a support frame 11, a drive mechanism 12, and a sealing mechanism 14.

The support frame 11 includes a support stand 15 having a base portion 16 and an upright 18. As shown, the upright 18 has a first end 19 which is affixed to the base portion 16 and a second end 20 from which extends a lateral support bar 22. A pair of generally rectangular side plates 23 are mounted to the lateral support bar 22 in a laterally spaced relationship. These side plates 23 are further affixed to one another by way of a front cross bar 24, and an intermediate cross bar 26. In addition to the cross bars 24 and 26 the side plates 23 are further connected by a cylinder support bar 28 and a pair of free rollers 27 and 30 which are journaled in the side panels 23 at the rear of the device. A table member 31 is removably fitted between the side plates 23 and rests on a plurality of table support rods 32. As shown, the support frame 11 is also provided with a reel support/tensioner assembly 34 which is mounted to the base portion 16 of the support frame 11.

Figure 4:
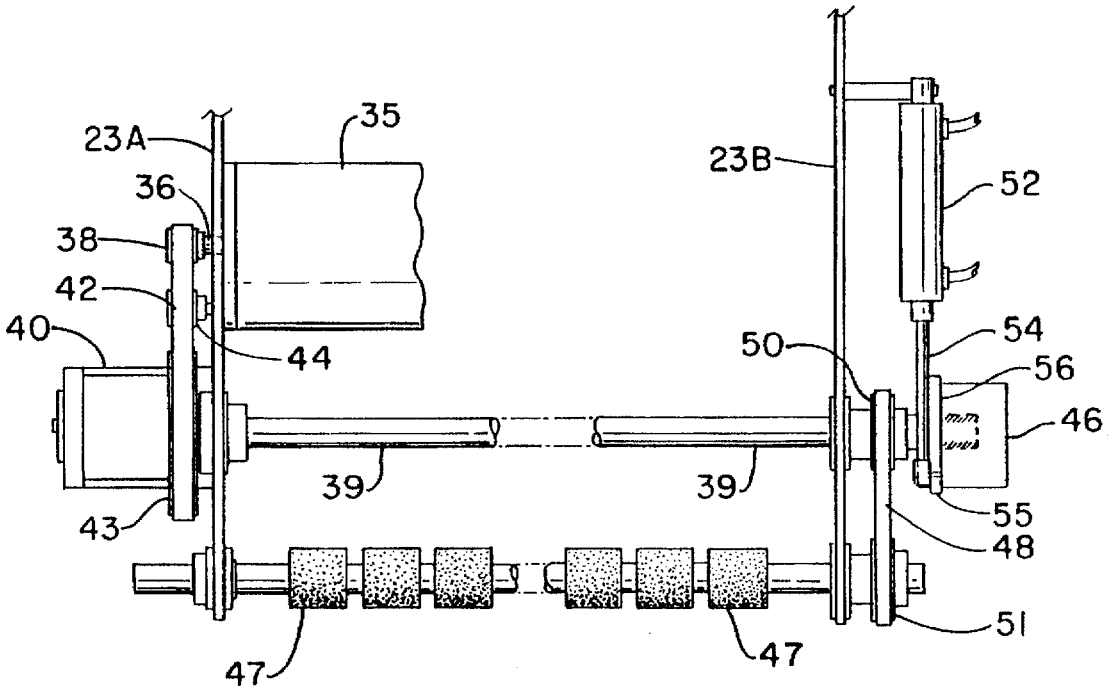
FIG. 4 is an enlarged top view of a portion of the apparatus of FIG. 1.
Figure 5:
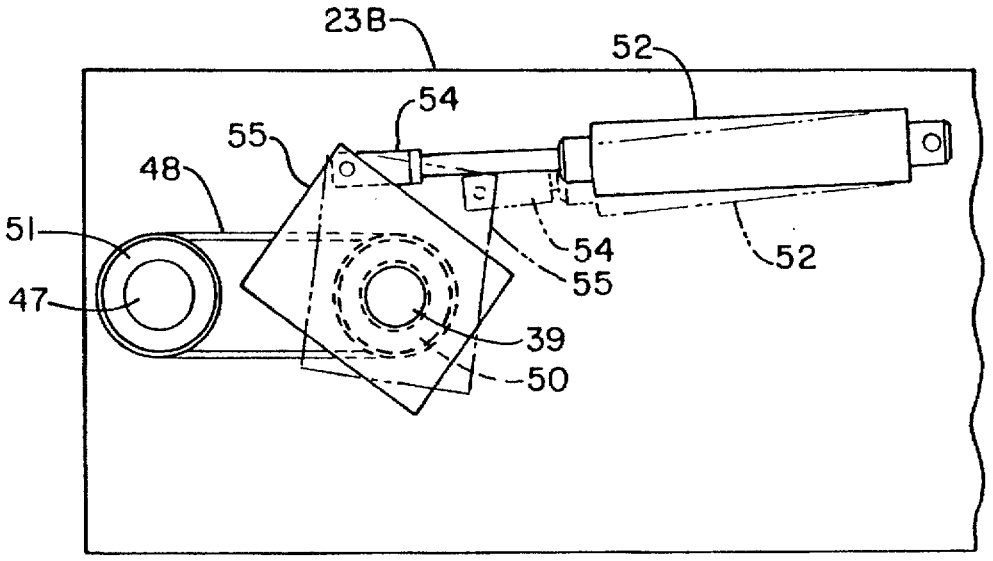
FIG. 5 is an elevational side view of the apparatus of FIG. 1.

With reference now to FIG. 1, it can be seen that the drive mechanism 12 includes a drive motor 35 which is mounted on the inside of the side plate 23A such that the motor shaft 36 extends through an aperture in the side plate. A timing pulley 38 is rigidly affixed to the end of shaft 36. A drive shaft 39 is journaled in the side plates 23 and extends through the side plate 23A to engage an electric clutch assembly 40 which is mounted on the outside of plate 23A. As can be seen, the electric clutch assembly 40 is drivingly engaged to the drive motor 35 by way of a timing belt 42 which engages the timing pulley 38 affixed to the motor shaft 36 and a second timing pulley 43 affixed to the clutch assembly 40. An adjustable belt tensioner 44 is provided between the first timing pulley 38 and the second timing pulley 43 to maintain the desired tension on the belt 42. The other end of drive shaft 39 is journaled in the side plate 23B and extends therethrough to engage an electric brake assembly 46. As is perhaps best shown in FIG. 4, drive shaft 39 drivingly engages a rubber roller 47 by way of a second timing belt 48. As shown, second timing belt 48 engages drive shaft 39 by way of timing pulley 50, and similarly engages roller 47 by way of timing pulley 51. It can also be seen that a pneumatic cylinder 52 is affixed to the side plate 23B with its push rod 54 linked to the electric brake assembly 46 by way of an actuating plate 55. Actuating plate 55 is a generally rectangular plate member which is rigidly affixed to the front plate 56 of the electric brake assembly 46.

It should now be recognized that motor 35 serves to drive the shaft 39 when clutch 40 is engaged. Accordingly, shaft 39 drives rubber roller 47 which is in frictional contact with an aluminum roller 58. Accordingly, the frictional engagement of the rubber roll 47 to the aluminum roller 58 allows bags to be fed between the respective rolls 47 and 58 so as to index the bags forwardly therethrough. Those skilled in the art should also recognize that the combination of the clutch 40, electric brake 46, and pneumatic cylinder 52 allows the rubber roll 47 to be disengaged from the drive motor 35 and partially rotated opposite the direction of drive rotation. This is accomplished by disengaging the drive belt 42 by disengaging the electric clutch 40. At the same time, the electric brake 46 is applied to lock the shaft 39 to the brake 46 and actuating plate 55. Thus, when the pneumatic cylinder 52 is actuated the drive shaft 39 is rotated in a direction opposite to the forward drive direction.

A feed drive assembly 59 is also provided to allow for automatic threading of the device 10. The feed drive 59 is comprised of a pair of guide rollers 60 which are mounted to the free roller 27 by way of roller guide blocks 62. A pair of guide belts 63 engage the guide rollers 60 and are further drivingly connected to the rubber roller 47. Accordingly, the drive belts 63 are maintained in frictional engagement with the table 31 due to spring tension applied to the roller guide blocks 62. Thus, bags may be fed between belts 63 and table 31 at the rear of the device 10 and conveyed forwardly to the rubber roller 47 and aluminum roller 58.

The apparatus also includes a perforation sensing device 66 preferably in the form of an electrical contact element 67 which is grounded to the aluminum roll 58. As such, bags are fed between the electrical contact element 67 of the perforation sensor 66 and the aluminum roll 58 such that the electrical contact element 67 is insulated from the aluminum roller 58. When a perforation passes beneath the contact element 67 and the roller 58, the contact element 67 is momentarily grounded to the roller 58 thereby establishing a closed circuit which sends a signal to a control logic unit (not shown). Those skilled in the art will recognize that the device 10 may also be provided with a bag opening means 69 preferably in the form of a continuous or impulsive air stream. Accordingly, as bags are passed beneath the air stream they are momentarily opened by inflation at which time they may be filled either manually or automatically.

Figure 6:
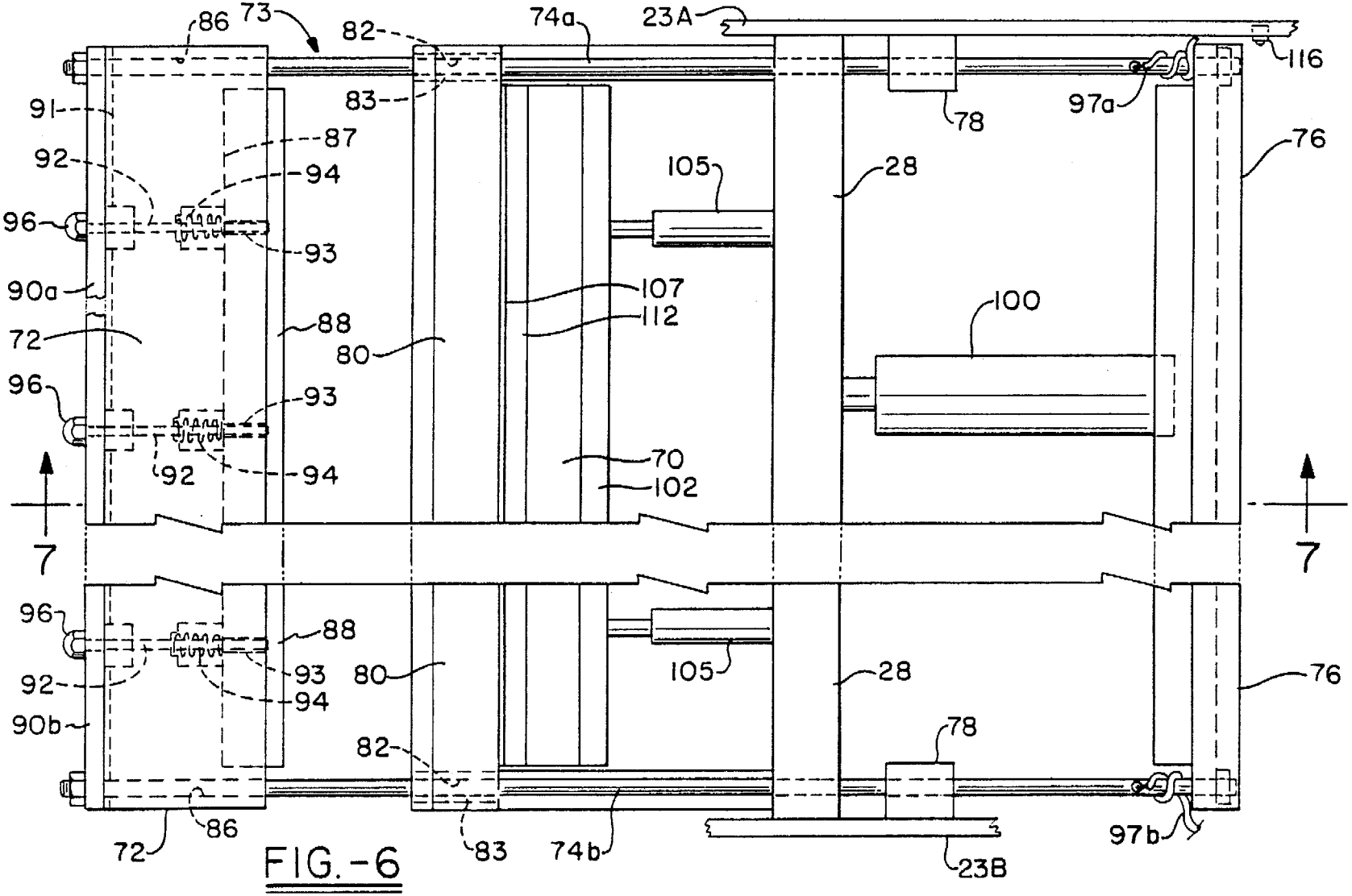
FIG. 6 is a top plan view of the clamping mechanism according to the present invention.
Figure 7:
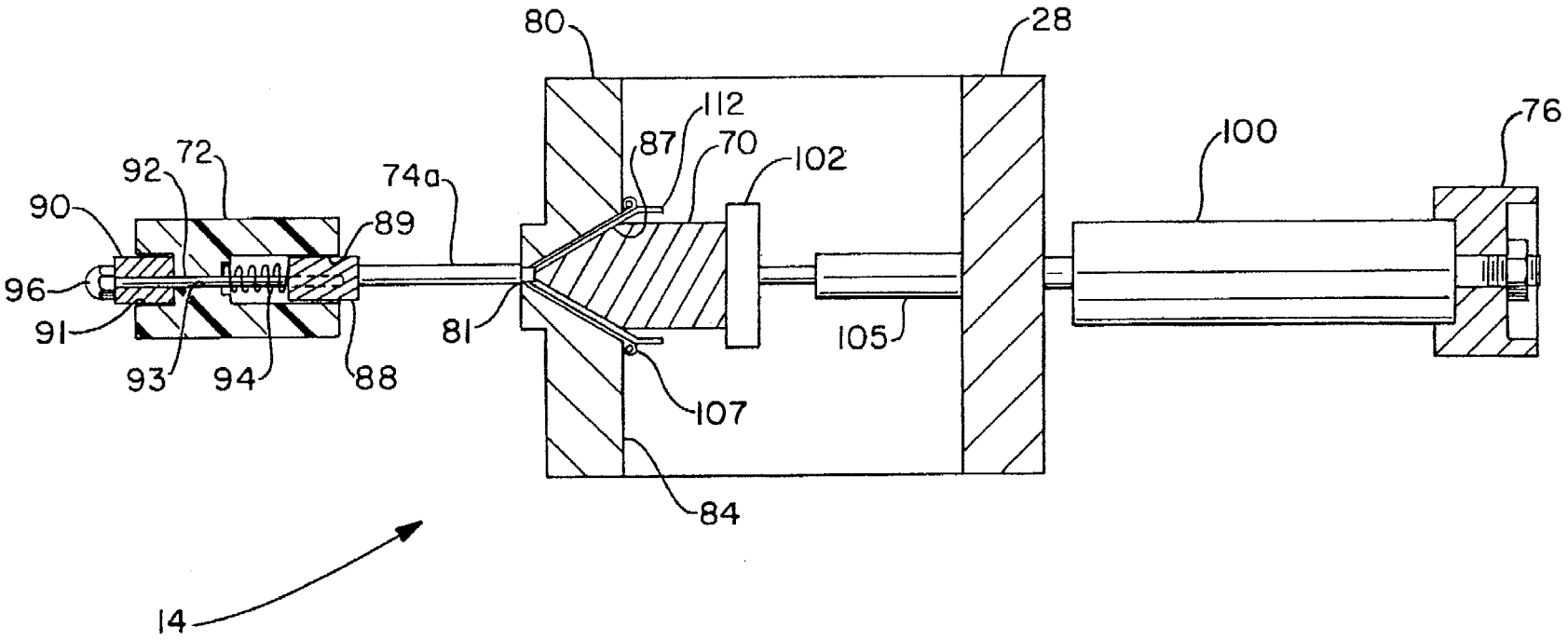
FIG. 7 is a cross sectional view of the mechanism of FIG. 6 taken along the line 7—7.

With reference now to FIGS. 6–7, it can be seen that the seal mechanism 14 is comprised of a seal bar 70 and a clamp bar 72. The clamp bar 72 is mounted on a clamp bar frame 73 comprising a pair of elongated cylindrical rods 74 which are laterally spaced from one another and affixed at one end to a rear frame member 76 and at the other end to clamp bar 72. The rods 74 pass through a pair of nylon mounting blocks 78 which are affixed to the side plates 23, and also pass through a gripper plate 80 mounted on the front of the device 10 as shown. The gripper plate 80 is of a generally rectangular shape having an elongated slot aperture 81 therein and a pair of rod guide apertures 82. For reasons which will become apparent as the description continues, the rod guide apertures 82 are lined with a nylon bushing 83 which acts as an electrical insulating bearing for the rods 74. The slotted aperture 81 opens to a V-shaped recess 87 in the rear face 84 of the gripper plate 80. The clamp bar 72 is preferably manufactured from a suitable nylon or other non-conductive material. The bar 72 includes a rod mounting aperture provided proximal to each end of the clamp bar 72. The clamp bar 72 also includes a pressure pad 88 which is fitted into a first notched recess 89 in one side of the clamp bar 72. Similarly, a plurality of contact strips 90 are received in a second notched recess 91 opposite the first notched recess 89. For reasons which will become apparent, it is preferable that there be at least two contact strips 90 mounted to the bar 72. The contact strips 90 are mounted to the bar 72 by way of screws 92 which pass through apertures 93 in the clamp bar 72 to engage the pressure pad 88. It should be noted that a pair of coil springs 94 are located on the screw 92 between the pressure pad 88 and the contact strips 90. Screws 92 are affixed to the contact strips 90 by way of acorn nuts 96. Accordingly, the spring bias pressure on the pressure pad 88 maintains the acorn nuts 96 in contact with the contact strips 90. However, when pressure is exerted against the pressure pad 88 the springs 94 are compressed and contact between the acorn nuts 96 and the contact strips 90 is broken. It is also important to note that the contact strips 90 are affixed to the rods 74 through the rod mounting apertures 86. An electrical current is provided through the clamp bar frame 73 by way of wires 97A and 97B which are connected to the rods 74A and 74B respectively. With wire 97A connected to a positive potential and wire 97B connected to a negative potential, an electrical circuit is established through the bar frame 73 by way of rods 74 and contact strips 90. As can be seen, the circuit between contact strips 90A and 90B is established through the pressure pad 88 when the pressure pad 88 is in the spring biased position. However, when a force is exerted against the pressure pad 88, contact is broken, resulting in an incomplete circuit. Thus it should be apparent that the rear frame member 76 must be made of a non-conducting material or alternatively the rods 74 must be insulated from the rear frame member 76 by way of nylon bushings, so as to prevent a short circuit between wires 97.

Clamp bar assembly 72 is actuated by way of a pneumatic cylinder 100 which is rigidly affixed to the support frame 11 by a mounting bar 28 and is also affixed to the rear frame member 76 of the clamp bar frame 73. Accordingly, when the pneumatic cylinder 100 is actuated the clamp bar frame 73 is selectively translated toward or away from the fixed gripper plate 80.

Seal bar 70 is mounted on a seal bar mounting plate 102 directly behind gripper plate 80 such that the leading edge 103 of seal bar 70 partially extends into the V-shaped recess 87 of plate 80. Accordingly, it is preferred that the leading edge 103 of seal bar 70 have a V-shaped tapered profile. Seal bar mounting plate 102 is mounted on a pair of pneumatic cylinders 105 which are in turn affixed to the mounting bar 28 opposite pneumatic cylinder 100. As such, when pneumatic cylinders 105 are actuated the seal bar mounting plate 102 and seal bar 70 are translated forward so as to protrude deeper into the recess 87 of gripper plate 80. The V-shaped leading edge of seal bar 70 extends slightly through slot aperture 81 at this point. Seal bar 70 is heated by passing an electric current through the bar. A non-stick material 107 is interposed between the seal bar 70 and the gripper plate 80 so as to prevent the seal bar 70 from sticking to bags during the sealing process.

Figure 8:
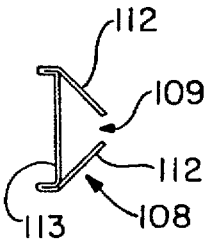
FIG. 8 is an elevational side view of the heat shield according to the invention.
Figure 9:
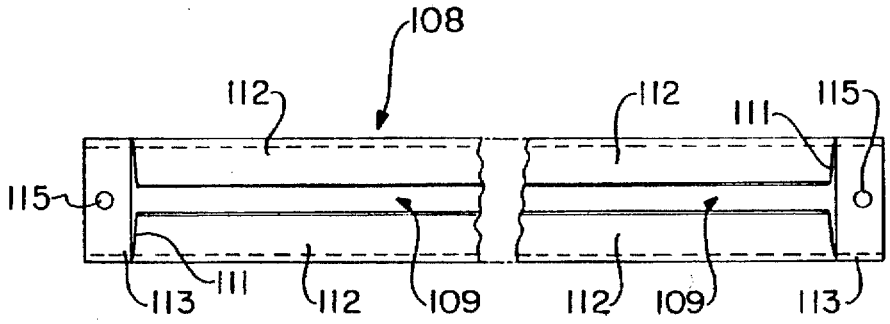
FIG. 9 is a front elevational view of the heat shield of FIG. 8.

Turning now to FIGS. 8 and 9, a novel aspect of the invention is the provision of an insulating shield 108 which is adapted to be interposed between the seal bar 70 and the non-stick material 107. The shield 108 is comprised of a thin strip of a resilient metal or other appropriate heat resistant material. The strip of material is of a generally rectangular shape and includes a slot 109 longitudinally therein. A pair of vertical slots 111 are also provided in the shield 108 so as to form tabs 112. As can be seen, the tabs 112 are bent slightly outwardly to form a V-shaped profile which compliments that of the gripper plate recess 87. Shield 108 is also provided with a pair of mounting tabs 113 at each end thereof, which include fastener apertures 115 for affixing the shield 108 to the gripper plate 80. As can be seen when the shield 108 is mounted to the gripper plate 80 the tabs 112 extend into the V-shaped recess 87 so as to allow only the leading edge 103 of the seal bar 70 to contact the non-stick material 107. Thus, only a small portion of the non-stick material 107 is subjected to the heat and frictional wear of the sealing process. Further, the shield 108 serves to prevent the non-stick material 107 from contacting the seal bar 70 at all times except during sealing.

As is perhaps best shown in FIG. 2, the gripper plate 80 with the clamp bar assembly 73 mounted therein, as well as the seal bar 70 are mounted directly below the aluminum roller 58. Thus, in operation, bags are fed from the reel support and tensioner assembly 34, mounted on the base 16 of the support frame 11, over the free roller 30 and into the feed drive assembly 59. Accordingly, the guide belts 63 guide the bags over the table 31 and into engagement with the rollers 47 and 58. As the bags pass over the aluminum roller 58, the perforation sensor 66 sends a signal to the control logic system so as to indicate the position of the individual bags. Simultaneously, the individual bag to be filled is opened by the air system 69. Also at this time the electric clutch assembly 40 is actuated to disengage the rubber roll 47 from the motor drive 35, and the electric brake assembly 46 is actuated to stop rotation of the rubber roll 47. Thus movement of the bags through the machine 10 is halted so that the bag may be filled either manually or automatically. After the bag is filled, pneumatic cylinder 100 is actuated so as to translate the clamp bar assembly 72 toward the gripper plate 80. Simultaneously, the pneumatic cylinders 105 are actuated to bring the seal bar 70 into contact with the gripper plate recess 87. Thus, the bag is clampingly held between the clamp bar 72 and the gripper plate 80 while the heat from the seal bar 70 seals it. While the bag remains clamped between the gripper plate 80 and clamp bar 72, the pneumatic cylinder 52 is actuated so as to rotate the rubber roll 47 in a direction opposite that of drive rotation. Accordingly, the filled and sealed bag is detached from the bag roll due to its inability to move rearwardly with the rest of the bags. After the filled bag has been detached the clamp bar 72 is translated forward by the pneumatic cylinder 100 and the bag falls onto a conveyor or into a collection bin and the control logic system disengages the brake 46 and the clutch 40 to allow the drive motor 35 to index the next bag into position so that the process can begin anew.

During the above described process, if an object is interposed between the clamp bar 72 and the gripper plate 80, the pressure exerted against the pressure pad 88 will cause the acorn nuts 96 to disengage from the contact strips 90 thereby breaking the circuit established by the clamp bar frame 73, the broken circuit serves to notify control logic of the interference and thus further actuation of the clamp bar assembly 72 by way of the pneumatic cylinder 100 is halted. To prevent the actuation of the clamp bar assembly 72 from being halted when the pressure pad 88 contacts the gripper plate 80 just prior to sealing the device 10 is provided with a magnetic proximity switch 116. Switch 116 is located on the support frame 11 at a location such that the switch 116 will only be actuated when the pressure pad 88 is in imminent contact with the gripper plate 80. As such, the actuation of the switch 116 is used to establish an alternate current path when the clamp bar circuit is broken, so as to prevent halting of clamp bar actuation.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the invention, reference should be made to the following claims.

What is claimed is:

1. In an apparatus for filling and sealing flexible poly bags provided on a continuous roll, the apparatus having means for heat sealing filled bags, the improvement comprising:

drive means for conveying the bags in a first direction into a position for filling and sealing;

brake means carried by a plate for holding said drive means when one of the bags reaches said filling position;

clamp means for maintaining the bags in position during sealing;

means for rotating said plate with an actuating cylinder to reverse said drive means by rotating said plate to cause said drive means to rotate in a direction opposite said first direction for detaching one of the bags from the continuous roll after sealing; and guide means for guiding the bags into engagement with said drive means.

2. The improvement in an apparatus for filling and sealing flexible poly bags as recited in claim 1, wherein said drive means comprises:

a drive shaft having first and second ends;

a first torque transfer device engaging said first end of said drive shaft;

a second torque transfer device engaging said second end of said drive shaft;

a drive motor drivingly connected to said first torque transfer device;

a first roll member drivingly connected to said second torque transfer device; and, a second roll member in frictional contact with said first roll member;

whereby said drive motor drives said first and second roll member when said first torque transfer device is engaged and said second torque transfer device is disengaged so as to convey the bags between said first and second roll members.

3. The improvement in an apparatus for filling and sealing flexible poly bags as set forth in claim 1, further comprising interrupt means for disengaging said clamp means when said clamp means is interfered with by a foreign object, said interrupt means comprising:

a non-conductive clamp bar member;

an electrically conductive pressure pad member mounted in said clamp bar member;

at least two electrically conductive contact strips mounted in said clamp bar member;

at least two rod members mounted in said clamp bar member, one of said at least two rod members electrically connected to one of said at least two contact strips and the other of said at least two rod members electrically connected to the other of said at least two contact strips;

fastener means for selectively biasing said pressure pad member to establish an electrical connection with said contact strips;

a positive electrical potential connected to one of said at least two rod members; and a negative electrical potential connected to the other of said at least two rod members;

whereby an electrical circuit is established between said positive potential and said negative potential when said fastener means biases said pressure pad member into electrical connection with said contact strips and said circuit is interrupted when said pressure pad is not biased into electrical connection with said contact strips.

4. The improvement in an apparatus for filling and sealing flexible poly bags as set forth in claim 1 wherein said clamp means comprises;

a gripper plate member having at least one rod guide aperture therein;

at least one rod member journaled in said rod guide apertures;

a clamp bar member connected to said at least one rod member; and actuating means for translating said rod member relative to said gripper plate so as to bring said clamp bar into contact with said gripper plate.

5. The improvement in an apparatus for filling and sealing flexible poly bags as set forth in claim 1, wherein said means for rotating comprises:

a drive shaft having first and second ends, said brake means engaging said second end of said drive shaft;

a first torque transfer device engaging said first end of said drive shaft;

a drive motor drivingly connected to said first torque transfer device;

a first roll member drivingly connected to said brake means;

a second roll member in frictional contact with said first roll member;

reverse actuating means connected to said brake means;

whereby said drive motor drives said first and second roll members when said first torque transfer device is engaged and said brake means is disengaged so as to convey the bags between said first and second roll members and the bags are detached when said first torque transfer device is disengaged, said brake means is engaged, said bags are maintained in said clamping means, and said reverse actuating means is actuated.

6. The improvement in an apparatus for filling and sealing flexible poly bags as set forth in claim 1, wherein said guide means comprises:

a table member mounted in said apparatus;

roller means in contact with said table member; and at least one belt member engaging said roller means and connected to said drive means, said roller means maintaining said belt means in frictional contact with said table member.

7. A device for detaching perforated poly bags from one another, comprising:

roll means for conveying poly bags;

drive means connected to said roll means for driving said roll means in a first direction;

brake means for holding said drive means to stop conveying poly bags;

an actuating plate affixed to said brake means and an actuating cylinder connected to said actuating plate whereby said brake means selectively engages said roll means to said actuating plate and said actuating cylinder rotates said roll means by reversibly rotating said actuating plate;

clamping means for selectively maintaining the bags in a fixed position;

whereby said drive means drives said roll means in a first direction and the bags are detached when said drive means is disengaged from said roll means, the bags are maintained by said clamping means, and said actuating plate is actuated to reversibly drive said roll means.

8. A device for detaching perforated poly bags as set forth in claim 7, wherein said roll means comprises a first roll member drivingly connected to said drive means, and a second roll member in frictional contact with said first roll member whereby the bags are conveyed between said first and second roll members.

9. A device for detaching perforated poly bags as set forth in claim 7, wherein said drive means comprises a drive shaft having first and second ends, said second end of said drive shaft connected to said roll means, a torque transfer device engaging said first end of said drive shaft, and a drive motor drivingly connected to said torque transfer device.

10. A device for detaching perforated poly bags as set forth in claim 9, wherein said torque transfer device is an electric clutch.

11. A device for detaching perforated poly bags as set forth in claim 7, wherein said brake means is an electric brake.

12. A device for detaching perforated poly bags as set forth in claim 7, wherein said actuating cylinder is a pneumatic cylinder.

13. A device for detaching perforated poly bags as set forth in claim 7, wherein said clamping means comprises a gripper plate, rod means slidably journaled in said gripper plate, a clamp bar connected to said rod means, and clamp bar actuating means for translating said clamp bar relative to said gripper plate.

14. A device for detaching perforated poly bags as set forth in claim 13, wherein said rod means comprises at least two laterally spaced rod members.

15. A device for detaching perforated poly bags as set forth in claim 14, wherein said clamp bar actuating means comprises an actuating plate rigidly affixed to said rod means and at least one actuating cylinder connected to said actuating plate.

16. A device for detaching perforated poly bags as set forth in claim 15, wherein said at least one actuating cylinder is a pneumatic cylinder.

* * * * *